United States Patent [19]

Ouchi et al.

[11] 4,408,652

[45] Oct. 11, 1983

[54] METHOD OF CONTINUOUSLY CASTING NICKEL CONTAINING STEEL WHEREIN SURFACE CRACKS ARE PREVENTED

[75] Inventors: Chiaki Ouchi, Yokohama; Tetsuya Sampei, Kawasaki, both of Japan

[73] Assignee: Nippon Kokan Kabushiki Kaisha, Tokyo, Japan

[21] Appl. No.: 286,032

[22] Filed: Jul. 22, 1981

[30] Foreign Application Priority Data

Jul. 23, 1980 [JP] Japan ..... 55-99833

[51] Int. Cl.[3] ..... B22D 11/00; C22C 38/06

[52] U.S. Cl. ..... 164/459; 75/124

[58] Field of Search ..... 164/459, 473; 75/124 B, 75/124 C

[56] References Cited

FOREIGN PATENT DOCUMENTS 595418 2/1978 U.S.S.R. ..... 75/124

*Primary Examiner*—Gus T. Hampilos

*Assistant Examiner*—Peter B. Martine

*Attorney, Agent, or Firm*—Frishauf, Holtz, Goodman & Woodward

[57] ABSTRACT

An improved method of continuously casting nickel containing steel wherein the formation of surface cracks is prevented. The molten steel which is cast contains less than 0.0020% S, less than 0.0045% N, Ca in an amount of from 0.0020 to 0.0070%, Ni in an amount from 5.5 to 10%, the remainder being Fe and unavoidable impurities.

7 Claims, 8 Drawing Figures

T : 500~1100 °C $T_1$ : 500 ~1000 °C
T : 750 ~1200 °C

METHOD OF CONTINUOUSLY CASTING NICKEL CONTAINING STEEL WHEREIN SURFACE CRACKS ARE PREVENTED

BACKGROUND OF THE INVENTION

This invention provide a method of preventing surface cracking on Ni containing, continuously cast steel products for service at low temperatures.

The continuous casting process has been remarkably developed in the steel making processes, since it omits the ingot-slabbing steps, to save the energy and the man power, or to increase the yield. The continuous casting process has qualitatively and quantitatively widened its available fields, and has been applied to Ni steel (5.5 to 10% Ni) such as 9%Ni steel and others for low temperature service.

However, the continuous casting of Ni steel has one serious problem. This is that the continuously cast steel products containing 5.5 to 10% Ni have many defects such as surface cracking on the steel product in comparison with low alloy steel, and therefore it necessitates complicated surface conditioning treatment such as cold scarfing or low degree slabbing as a pre-process to a hot rolling operation in a subsequent process. These treatments act as obstacles so that the above mentioned merits could not be satisfactorily displayed.

In regard to causes of the surface cracking, it is in general known that, under a condition that the $\gamma$ (austenite) grain boundary is embrittled by second phase (sulfides or nitrides) precipitating at the $\gamma$ grain boundary, when tensile stress exceeding a certain limit is loaded about the steel surface, nuclei of voids or pores are generated as encircling the second phase, and those voids link up with one another and finally cause cracks. Since in the continuous casting process there is generated stress in the continuously cast steel between the rolls in the cooling zones, or thermal stress by repetition of cooling and heat recuperation, surface cracking is more easily caused than in a conventional ingot casting process.

To decrease the surface cracking on the continuously cast products such as billets, slabs, blooms and so on (briefly called as "slab" representatively hereinafter), the prior art has adopted methods of controlling requirements such as the casting temperatures or speeds, or controlling demands such as the amount of cooling water in the secondary cooling zone, or using electromagnetic stirring. Even if limitation is provided as to the casting condition or the cooling condition with respect to Ni steel, the occurrence of the surface cracking could not be prevented.

In view of these circumstances, the present invention has been proposed through many investigations and studies.

An object of the invention is to provide a method of manufacturing Ni containing steel slabs for low temperature service by the continuous casting process, without providing any limitations as to the casting condition or the cooling condition, whereby to reduce or eliminate the surface cracking on the continuously cast steel slab so that the surface conditioning treatment prior to the final rolling is no longer required.

For accomplishing the object, the investigations have been carried out about the cause of the surface cracking and the countermeasure thereto for a long term, in which, by specifying the chemical composition of molten steel to be continuously cast, it was succeeded to obtain steel cast slabs with no surface cracking and not requiring any treatment for removing these surface cracks.

That is, the invention is characterized in that, for continuously casting 5.5 to 10% Ni containing steel, the chemical composition of the molten steel is adjusted to provide S less than 0.0020%, N less than 0.0045% and Ca 0.0020 to 0.0070%, and further characterized in that Ti content is adjusted 0.005 to 0.015%, and such molten steel is continuously cast.

Hereafter, the present invention will be explained with reference to the attached drawings.

DETAILED DESCRIPTION OF THE INVENTION

It is well known as mentioned above that the occurrence of the surface cracks in continuously cast slabs has a close relation with poor hot ductility in the temperature range after solidification, and the surface cracks should be removed from the slabs before the hot rolling operation.

Figure 1:
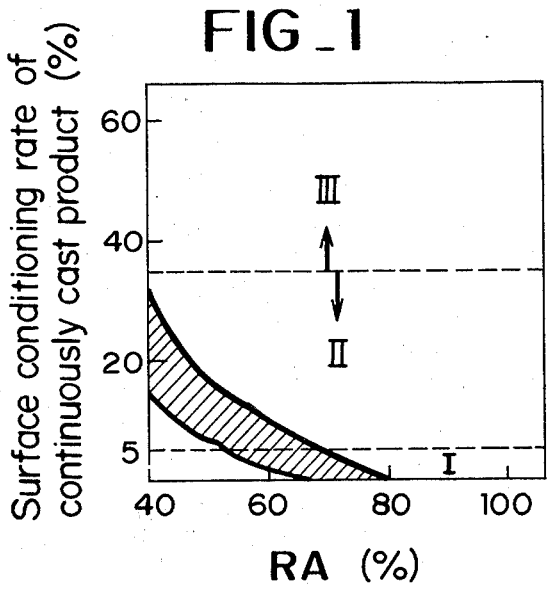
FIG. 1 is a graph showing the relationship between hot ductility (RA) by high temperature tensile testing and surface conditioning rate on the continuously cast Si-Mn steel and Si-Mn steel bearing a small amount of Nb and/or V, FIGS. 2(A) and (B) are graphs showing thermal cycles to obtain hot ductility with hot tensile test.
Figure 2A:
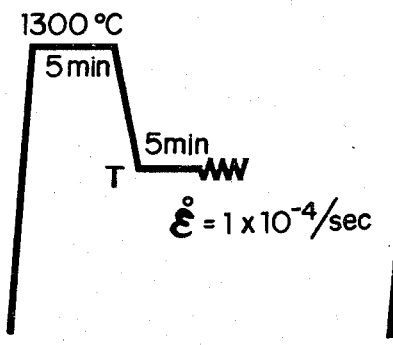
Figure 2B:
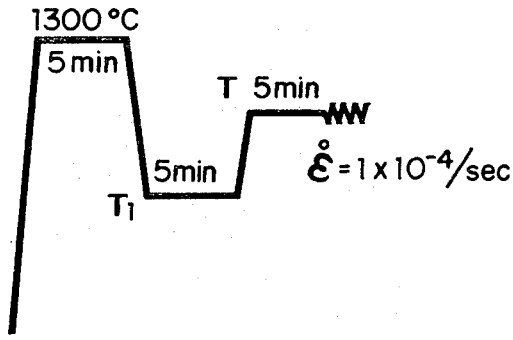

For quantitatively seeking the relation between the surface conditioning removal rate and the hot ductility at high temperature, the inventors undertook the high temperature tensile tests on Si-Mn steel and Si-Mn steel containing a small amount of Nb and/or V and checked the relation of the reduction of area (RA) and the defect removal treatment rate of the continuously cast slabs. FIG. 1 shows results with respect to the slabs, in which (I) is a range which requires little surface conditioning treatment, (II) is a range which will be available by the surface conditioning treatment, and (III) is a range which is hardly available since it requires a large amount of surface conditioning treatment. FIG. 2 show simulated thermal cycles assumed to be present in the surface layer of the steel slabs. FIG. 2(A) corresponds to the cooling stage of the continuously cast slab after solidification, where the stress is acting on the surface by the thermal stress or the rolling at the temperature cooling the surface after solidification, and FIG. 2(B) corresponds to the recuperating stage of the continuously cast slab, where the stress is acted on the surface at the temperature heightened after having been once cooled.

As is seen from FIG. 1, a steel slab of poor hot ductility (RA) requires a large degree surface conditioning treatment, and there are cast slabs made useless because of excessive treatment. As noted from FIG. 1, the surface conditioning rate decreases as the hot ductility increases. The hot ductility (RA) of more than 70% requires the surface conditioning treatment of less than 5%.

Figure 3:
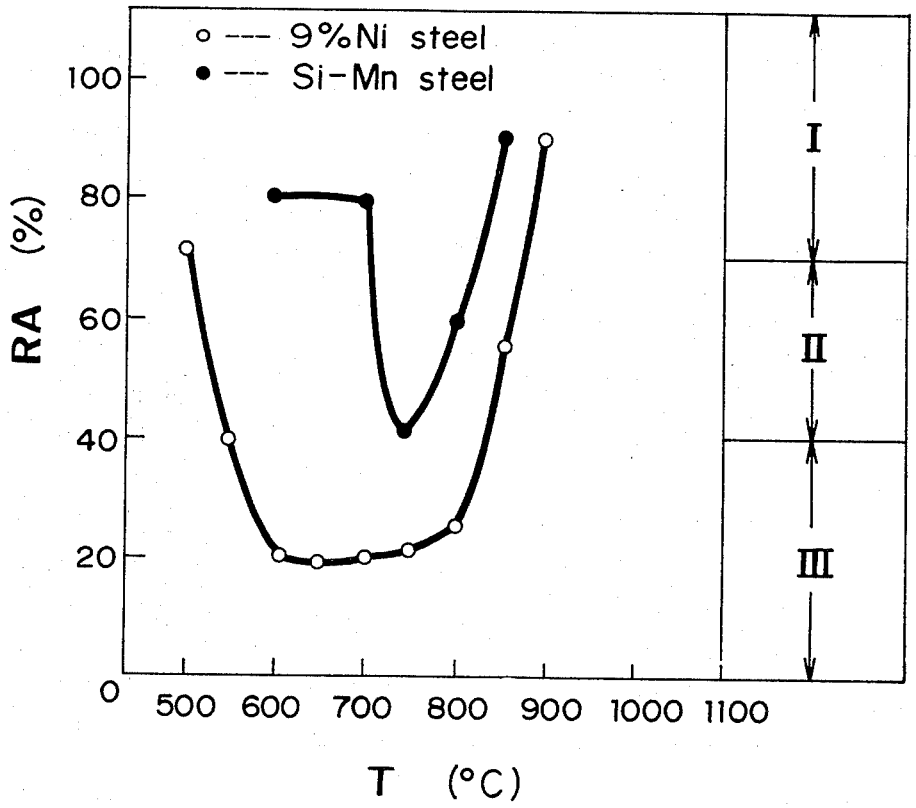
FIG. 3 is a graph showing difference in the hot ductility between 91%Ni steel and Si-Mn steel.

FIG. 3 shows the difference of the hot ductility in the thermal cycle as shown in FIG. 2(A) between Si-Mn steel as a typical sort of the low alloy steel and 9%Ni steel as a typical sort of the Ni containing steel for low temperature service. (I), (II) and (III) in FIG. 3 correspond to (I), (II) and (III) in FIG. 1, respectively. The chemical compositions of the above steels are shown in Table 1.

TABLE 1

| | (Wt %) | | | | | | | |
|---|---|---|---|---|---|---|---|---|
| Steels | C | Si | Mn | P | S | Ni | sol. Al | T-N |
| 9% Ni | 0.07 | 0.17 | 0.47 | 0.011 | 0.005 | 8.80 | 0.038 | 0.0031 |
| Si—Mn | 0.15 | 0.29 | 1.36 | 0.013 | 0.006 | — | 0.022 | 0.0066 |

T-N: Total N

FIG. 3 shows the large difference in the hot ductility (RA). This difference is caused as follows.

Although the temperature range of the austenite is more than 700° C. in the low alloy steel such as Si-Mn steel, it is from solidification temperature to 450°-600° C. in Ni steel. The latter means that the temperature range of the cracking occurrence is wide which is caused by embrittlement of $\gamma$ grain boundary effected by the second phase precipitation at the $\gamma$ grain boundary. To say this in detail, as seen in both the 9%Ni steel and Si-Mn steel in FIG. 3, the hot ductility (RA) is rapidly improved as the austenite phase transforms into a ferrite phase and the amount of the ferrite phase is increased. This would be assumed, in addition to the fact of the contrary nature of both phases, that the transformation into the ferrite first starts at the austenite grain boundary, and since substance precipitating at the grain boundary to lower the hot ductility (RA) when the phase is austenite, is present where initial transformation takes place at the same time as the transformation starts, said precipitating substance is surrounded with the ferrite grain, and this does not come into existence at the grain boundary of new born ferrite-austenite. The existence of the precipitating substance at the $\gamma$ grain boundary adversely affects the hot ductility, and this would be apparent when considering that when the test temperature T exceeds a certain temperature in FIGS. 3 and 4 and said precipitating substance is resolved into the matrix, the hot ductility (RA) rapidly recovers though the steel structure is the same austenite.

The reason why a big difference appears in the hot ductility (RA) between Si-Mn steel and 9%Ni steel, depends upon difference in the solidified structure. That is, the low alloy steel such as Si-Mn steel transform from the molten steel to $\delta$ solidification and to $\gamma$ phase, and the transformation $\delta-\gamma$ is repeated in accordance with cooling-recuperation in the solidifying surface layer in the cooling process. Therefore, the surface layer or the solidifying layer near thereto where the surface cracking easily take place, becomes equi-axed, and after having been more than a certain depth said layer become columnar structure. On the other hand, Ni steel instantly advances from the molten state to $\gamma$ solidification, and therefore it does not transform in spite of the repetition of cooling-recuperation after solidification during the cooling process, and the columnar structure develops from the surface layer or the structure under the surface. Such a structure has a good chance of crackings by the lengthwise stress. Besides, Ni steel is high in cracking susceptibility to a certain stress in comparison with the low alloy steel.

Consequently, Ni steel has low hot ductility over a wide temperature range as shown in FIG. 3 and the hot ductility value (RA) is low per se. Furthermore, in Ni steel, the Mn content is as low as about 0.5% owing to various regulations, and therefore MnS again solidifies and preciitates at the $\gamma$ grain boundary in accordance with the recuperation-cooling, and has strong susceptibility to bad influence by the S.

In view of the above mentioned matters, the hot ductility (RA) should be heightened in each of the thermal cycles to prevent surface cracking, and in the actual practice, it is metallurgical parameters as seen in FIG. 1 that improve the hot ductility (RA) more than 70%.

The present invention has solved the problem of providing hot ductility (RA) of more than 70%, which was impossible in the existing technique, in Ni steel by means of adjusting the chemical composition without limiting the casting and the cooling condition in the continuous casting. This is based on a technique of perfectly controlling the second phase (sulfides or nitrides) precipitating at the $\gamma$ grain boundary, that is, preventing the precipitation of the sulfide such as MnS and the nitride such as AlN.

To say more actually with respect to the continuous casting of Ni steel while effecting the $\gamma$ solidification, (1) adjusting N content and S content as the impurities in the steel less than 0.0045% and less than 0.0020%, respectively, and adding Ca in range between 0.0020% and 0.0070%, (2) adding Ti in range between 0.005% and 0.015% to the adjusted composition in (1).

Depending upon (2), the hot ductility (RA) can be further improved.

The reason for limiting the above mentioned components is as follows.

Less than 0.0045% N: if exceeding 0.0045%, the solute Al and N embrittle, as AlN, the grain boundary at the low $\gamma$ temperature range, and an RA of more than 70% could not be obtained.

Less than 0.0020% S: if exceeding 0.0020%, MnS solidifies, even if Ca is added, into the matrix during the cooling process in the continuous casting process and embrittles the $\gamma$ grain boundary, and an RA of 70% could not be obtained.

0.0020 to 0.0070% Ca: Ca modifies the form of MnS as oxysulfide, and prevents MnS re-precipitation in the solution to keep scattering in the matrix and check re-precipitation into the grain boundary. If less than 0.0020%, said effects could not be obtained, and if exceeding 0.0070%, it spoils cleanliness of the steel and injures the materials properties.

0.005 to 0.15% Ti: Ti combines N as TiN into the matrix in the high temperature range of $\gamma$ during the solidifying process, and prevent solute Al and N from precipitating as AlN in the grain boundary in the low temperature range of austenite $\gamma$. If being less than 0.005% said effects could not be obtained and an RA of more than 70% could not be obtained. But addition of more than 0.015% is unnecessary and greatly increases the strength of the product and brings about deterioration of toughness.

In the chemical composition, 5.5 to 10.0% Ni only is an essential requirement, and any limitation is not made to other elements.

With respect to the other components than Ni, it is of course preferable that the steel is, as the known Ni steel, composed of 0.02 to 0.10% C, 0.02 to 0.50% Si, 0.35 to 0.85% Mn, 0.005 to 0.05% sol.Al. and the balance being Fe and unavoidable impurities, otherwise further contains one or more than two of less than 0.5% Cu, less than 0.5% Cr and less than 0.5% Mo. If Ni is less than 5.5% the transformation goes along the solidifying process of the liquidus phase—$\delta-\gamma$, and it is outside of the invention. If Ni exceeds 10%, an improvement could not be brought about on the toughness at the low temperature as much as such increase, and it is also outside of the invention.

The invention carries out conventionally the continuous casting of Ni containing steel of said components without requiring any special limitations (casting condition and cooling condition). By the present method, the cast slab may be produced with a hot ductility of more than 70% and without surface cracking.

EXAMPLE

According to the invention, 9%Ni steel as typical of a $\gamma$ solidifying Ni steel was continuously cast. Table 2 shows the chemical composition of the test pieces.

Figure 4:
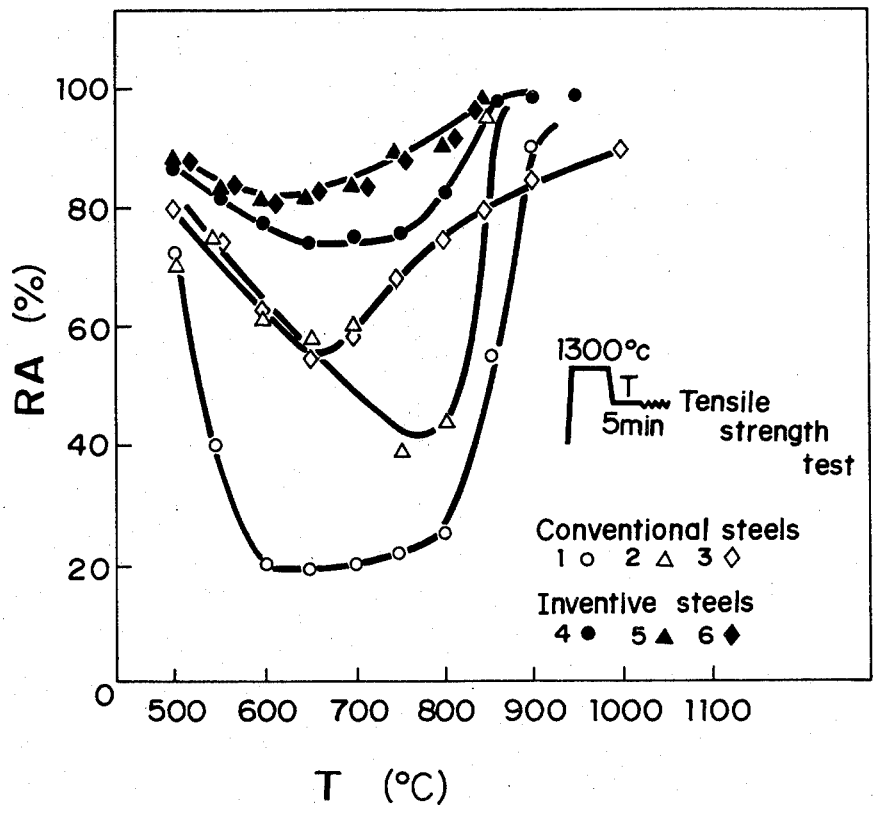
FIGS. 4 to 6 are graphs showing results of tests on the hot ductility in the various thermal cycles with steels obtained by the present method and the conventional method, and FIG. 7 are graphs showing the optimum ranges of S, N, Ca and Ti contents for providing hot ductility (RA) of more than 70%.
Figure 5:
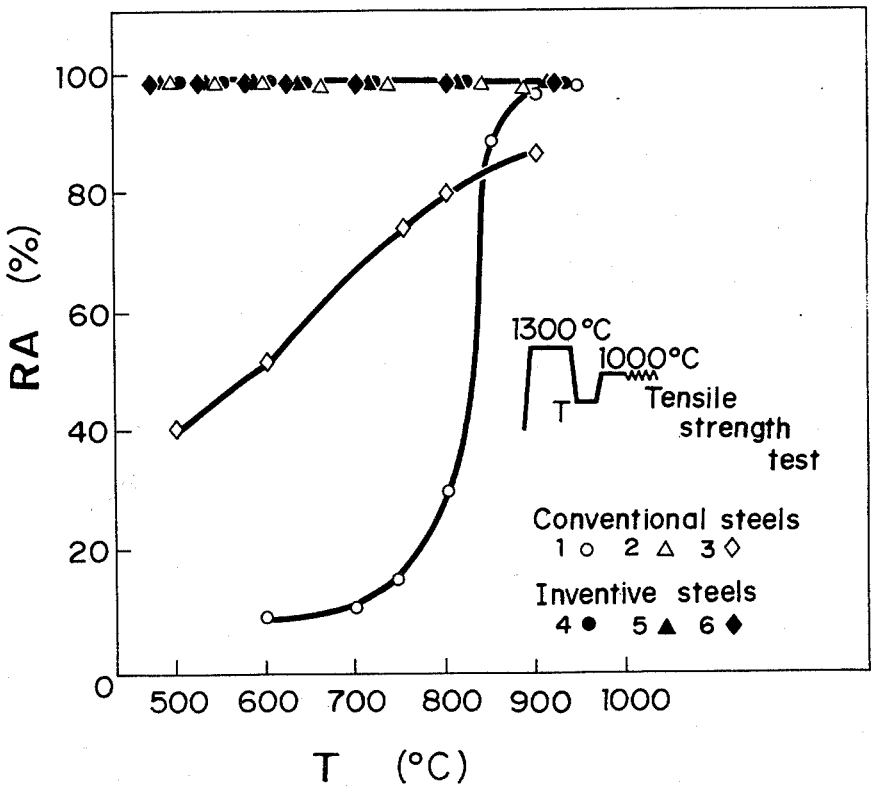
Figure 6:
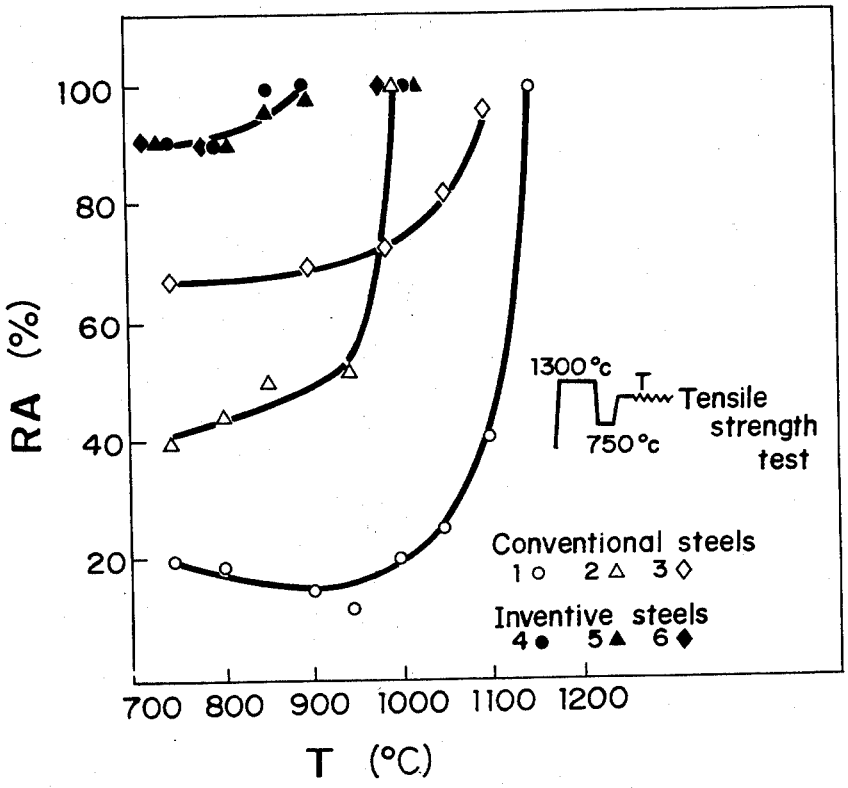

FIGS. 4 to 6 show the thermal cycles of the test pieces and results of the hot ductility tests corresponding thereto.

TABLE 2

| | | (Wt %) | | | | | | | | | |
|---|---|---|---|---|---|---|---|---|---|---|---|
| | | C | Si | Mn | P | S | Ni | Ti | Ca | sol. Al | T-N |
| A | 1 | 0.07 | 0.17 | 0.47 | 0.011 | 0.0050 | 8.80 | — | — | 0.038 | 0.0031 |
| | 2 | 0.06 | 0.21 | 0.52 | 0.013 | 0.0019 | 9.06 | — | — | 0.045 | 0.0023 |
| | 3 | 0.06 | 0.22 | 0.55 | 0.013 | 0.0050 | 8.96 | 0.012 | — | 0.045 | 0.0019 |
| B | 4 | 0.05 | 0.18 | 0.54 | 0.011 | 0.0015 | 8.90 | — | 0.0056 | 0.028 | 0.0016 |
| | 5 | 0.05 | 0.18 | 0.55 | 0.011 | 0.0009 | 8.70 | 0.008 | 0.0058 | 0.036 | 0.0016 |
| | 6 | 0.06 | 0.18 | 0.49 | 0.011 | 0.0014 | 8.81 | 0.013 | 0.0057 | 0.034 | 0.0028 |

A: Conventional Steels
B: Steels of This Invention
T-N: Total N

As is seen from Table 2, and FIGS. 4 to 6, in comparison with the conventional steels (1: Ordinary Steel; 2: Low S Steel; 3: Ti addition Steel), the inventive steels (4: Low S-Ca; 5 and 6: Low S-Ca-Ti Steel) are excellent in hot ductility and each shows hot ductility (RA) of more than 70% in any of the thermal cycles. The surface cracks are effectively avoided as apparent in view of FIG. 1 or 3.

For defining the limiting scope of each of the components, investigations were undertaken on the relation between the lowest hot ductility (RA), S content and N content, and on the effects of Ca addition and Ti addition, with respect to Ni steel other than the steels shown in Table 2. The results are shown in FIG. 7.

Figure 7:
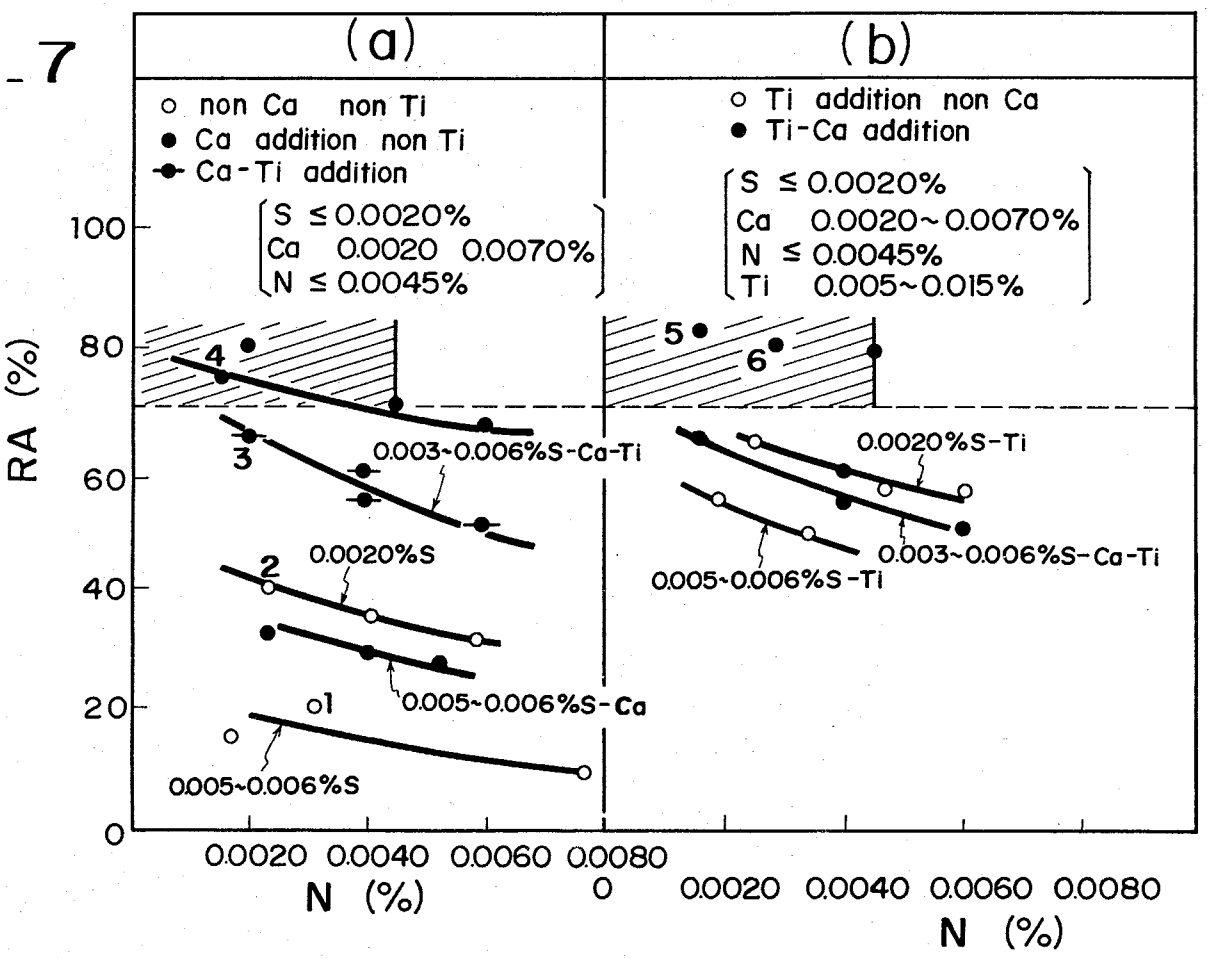

In (a) column of FIG. 7, white mark (o) is steel without Ca, black mark (•) is Ca addition steel, and black+-bar (-•-) is Ca-Ti steel. This drawing discloses that in the hatched area, i.e., the hot ductility of more than 70% is found in only the steels of less than 0.0020% S, less than 0.0045% N and Ca addition.

In (b) column of FIG. 7, white mark is Ti addition steel, and black mark is Ti-Ca steel. This drawing discloses that the hatched area, i.e., the hot ductility of more than 70% is found in the steels of less than 0.0045% N and simultaneous addition of Ti and Ca. The hot ductility thereof is better than sole Ca addition steel.

The inventive steel was subjected to one directional rolling and the ordinary heat temperature for 9%Ni steel, and the strength and the was confirmed. The results showed that the ductility value was high in comparison with the foregoing steel, and the anisotropy was low.

In the present invention, in the continuous casting of 5.5 to 10% Ni steel, the component itself is specified without providing any limitations concerning the casting and the cooling conditions, thereby to effectively avoid surface cracking, so that the complicated surface conditioning treatment on the cast slab prior to rolling of the subsequent process may be omitted and the merits of the continuous casting may be fully displayed.

We claim:

1. An improved method of continuously casting nickel-containing steel wherein the formation of surface cracks is prevented comprising continuously casting molten nickel steel in the form of a continuous casting, the improvement wherein said molten nickel-containing steel comprises less than 0.0020% S, less than 0.0045% N, Ca in an amount from 0.0020 to 0.0070%, Ni in an amount from 5.5 to 10%, the remainder being Fe and unavoidable impurities.

2. The method of claim 1 wherein said steel also contains Ti in an amount from 0.005 to 0.015%.

3. The method of claim 1 or 2 wherein said steel also contains 0.02 to 0.10% C, 0.02 to 0.50% Si, 0.35 to 0.85% Mn, and 0.005 to 0.05% sol Al.

4. The method of claim 1 or 2 wherein said steel also contains one metal selected from the group consisting of Cu in an amount less than 0.5%, Cr in an amount less than 0.5% and Mo in an amount less than 0.5%.

5. The method of claim 3 wherein said steel also contains one metal selected from the group consisting of Cu in an amount less than 0.5%, Cr in an amount less than 0.5% and Mo in an amount less than 0.5%.

6. The method of claim 1 or 2 wherein said steel also contains Cu in an amount less than 0.5%, Cr in an amount less than 0.5%, and Mo in an amount less than 0.5%.

7. The method of claim 3 wherein said steel also contains Cu in an amount less than 0.5%, Cr in an amount less than 0.5% and Mo in an amount less than 0.5%.

* * * * *